US008611793B2

(12) United States Patent
Zaretsky et al.

(10) Patent No.: US 8,611,793 B2
(45) Date of Patent: Dec. 17, 2013

(54) ELECTRICAL RECONDITIONING FOR PRINTER PHOTORECEPTOR

(75) Inventors: Mark Cameron Zaretsky, Rochester, NY (US); David Steven Weiss, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 312 days.

(21) Appl. No.: 13/212,223

(22) Filed: Aug. 18, 2011

(65) Prior Publication Data

US 2013/0045027 A1 Feb. 21, 2013

(51) Int. Cl.
*G03G 21/08* (2006.01)
*G03G 21/06* (2006.01)

(52) U.S. Cl.
USPC ..... 399/129; 399/349

(58) Field of Classification Search
USPC ..... 399/129, 349, 357
See application file for complete search history.

(56) References Cited

U.S. PATENT DOCUMENTS 4,252,433 A * 2/1981 Sullivan ..... 399/357
5,809,382 A 9/1998 McGuire et al.
6,070,032 A * 5/2000 Rokutanda et al. ..... 399/128
6,117,602 A 9/2000 Liu et al.
6,188,861 B1 2/2001 Parker et al.
7,286,788 B2 10/2007 Kinoshita et al.
7,773,933 B2 * 8/2010 Ishino et al. ..... 399/349

FOREIGN PATENT DOCUMENTS

JP 58105277 A * 6/1983 ..... G03G 21/00
JP 59198482 A * 11/1984 ..... G03G 21/00
JP 2005181613 A * 7/2005 ..... G03G 21/08

* cited by examiner

*Primary Examiner* — Clayton E Laballe
*Assistant Examiner* — Leon W Rhodes, Jr.
(74) *Attorney, Agent, or Firm* — Christopher J. White

(57) ABSTRACT

Apparatus for electrically reconditioning a rotatable photoreceptor in an electrophotographic (EP) printer includes a charger, an exposure subsystem, a transfer station, and an erase lamp arranged in that order around the photoreceptor in the direction of rotation thereof. A first corona electrode is disposed within 3 cm of the surface of the photoreceptor, but not in contact therewith, between the transfer station and the erase lamp. The transfer station and the erase lamp are at most 1 cm apart. A second corona electrode is disposed within 3 cm of the surface of the photoreceptor, but not in contact therewith, after the erase lamp in the direction of rotation of the photoreceptor. The erase lamp and the second corona electrode are less than 1 cm apart.

6 Claims, 8 Drawing Sheets

ELECTRICAL RECONDITIONING FOR PRINTER PHOTORECEPTOR

FIELD OF THE INVENTION

This invention pertains to the field of printing and more particularly to effectively cleaning photoreceptors in electrophotographic printers.

BACKGROUND OF THE INVENTION

Electrophotographic (EP) printers deposit toner on a receiver in a pattern defined by a charge pattern ("latent image") on a photosensitive member ("photoreceptor"). Photoreceptors are generally drums or belts that rotate to produce successive images on one or more receivers. Any given point on the photoreceptor, as it rotates 360°, passes through a sequence of steps that make up the EP process.

When toner is transferred from the photoreceptor to the receiver, it is not always transferred completely. To maintain image quality, it is desirable to remove this residual toner before applying a new toner pattern to the photoreceptor. In general, before charging the photoreceptor at the beginning of the electrophotographic image-forming process, it is desirable to prepare the photoreceptor for charging. Cleaning toner off the photoreceptor is a mechanical reconditioning process. The mechanical reconditioning is part of the photoreceptor-preparation process that prepares the photoreceptor for its next rotation (or its first rotation, e.g., when run at printer startup). Photoreceptor preparation also includes electrical reconditioning: the latent image is erased to prevent residual image formation. Residual image formation, also called "ghosting" or "ghost-image formation," is the appearance in a subsequently-printed image of part of a previously-printed image, and undesirably reduces image quality. Various schemes have been developed for performing this photoreceptor preparation process.

U.S. Pat. No. 7,286,788 to Kinoshita et al. describes two auxiliary charging brushes in contact with the photoreceptor between the transfer zone, in which area toner is transferred from the photoreceptor to the receiver, and the charger, which uniformly charges the photoreceptor to prepare it to receive a new latent image. The first brush has an AC and a DC bias to recover residual toner and erase the latent image on the photoreceptor. The second brush has a DC bias to charge any remaining residual toner so that it does not transfer to the charger.

However, in this scheme some toner remains on the photoreceptor on successive revolutions of the photoreceptor. This toner can be transferred to the receiver and appear as noise in an image or as an outline of a previous image. Either reduces image quality. Moreover, the mechanical contact of the two brushes with the photoreceptor produces friction. This friction increases the power required to drive the photoreceptor, and can produce mechanical wear on the surface of the photoreceptor that will eventually render the photoreceptor unsuitable for use.

U.S. Pat. No. 6,163,672 to Parker et al. describes using tri-level xerographic modules to create images having custom charged-area development (CAD) and discharged-area development (DAD) image areas. However, this scheme does not provide mechanical reconditioning (e.g., toner removal) after re-charging and erasing. Instead, additional toning is performed.

It is known to use detack corona chargers to help release receiver sheets from transfer rollers. In various schemes, detack corona chargers are designed to spray enough charge to reduce the electrostatic force of attraction between the receiver and the photoreceptor but not so much as to degrade transfer efficiency. However, if this scheme were used to try to release toner from a photoreceptor by charging all or substantially all the toner on the photoreceptor to the same sign, trapped charges created after exposure to an erase lamp could remain in the photoreceptor, possibly reducing image quality by producing ghost images. There is, therefore, a continuing need for an improved way of effectively preparing a photoreceptor without introducing mechanical wear and without causing image artifacts.

SUMMARY OF THE INVENTION

According to an aspect of the present invention, there is provided apparatus for electrically reconditioning a rotatable photoreceptor in an electrophotographic (EP) printer, comprising:

a) the EP printer having the rotatable photoreceptor;

b) a charger, an exposure subsystem, a transfer station, and an erase lamp arranged in that order around the photoreceptor in the direction of rotation thereof;

c) a first corona electrode disposed within 3 cm of a surface of the photoreceptor, but not in contact therewith, between the transfer station and the erase lamp, the transfer station and the erase lamp being less than 2 cm apart; and d) a second corona electrode disposed within 3 cm of the surface of the photoreceptor, but not in contact therewith, after the erase lamp in the direction of rotation of the photoreceptor, the erase lamp and the second corona electrode being less than 1 cm apart.

An advantage of this invention is that it electrically reconditions the photoreceptor so it is ready for charging. It does not induce image artifacts, and various embodiments reduce the occurrence of ghost images. Various embodiments reduce the sensitivity of the fully charged photoreceptor to the intensity of the erase lamp. Various embodiments can use a variety of electrodes, such as pin electrodes, sharp-edged blades, or static string. Various embodiments can use electrodes of narrow length in the rotational direction of the photoreceptor, enabling the use of multiple electrodes within a small area.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
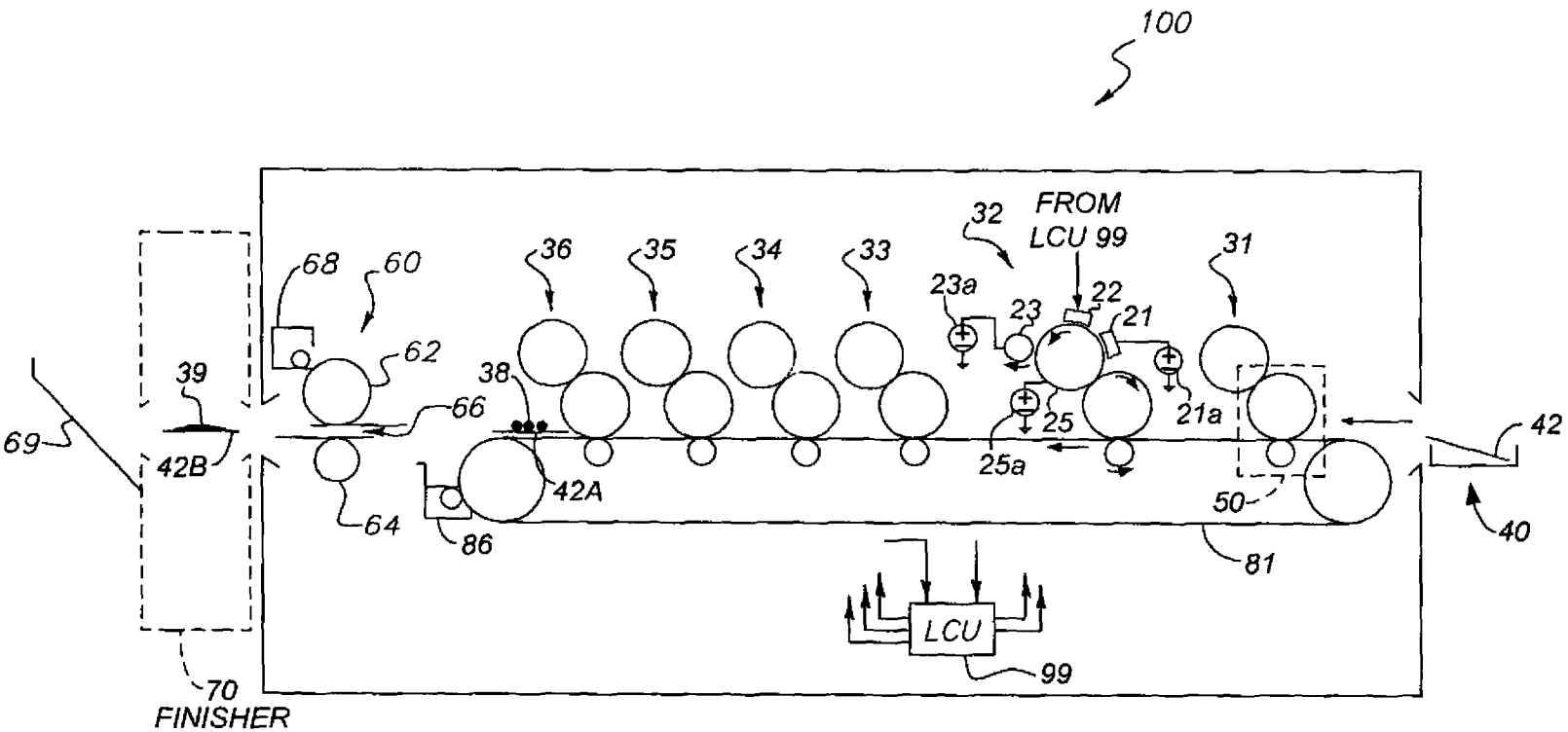
FIG. 1 is an elevational cross-section of an electrophotographic reproduction apparatus suitable for use with this invention.

The attached drawings are for purposes of illustration and are not necessarily to scale.

DETAILED DESCRIPTION OF THE INVENTION

In the following description, some embodiments of the present invention will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, the method in accordance with the present invention. Other aspects of such algorithms and systems, and hardware or software for producing and otherwise processing the image signals involved therewith, not specifically shown or described herein, are selected from such systems, algorithms, components, and elements known in the art. Given the system as described according to the invention in the following description, software not specifically shown, suggested, or described herein that is useful for implementation of the invention is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method according to the present invention.

The electrophotographic (EP) printing process can be embodied in devices including printers, copiers, scanners, and facsimiles, and analog or digital devices, all of which are referred to herein as "printers." Various aspects of the present invention are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, a laminator system, a sorting system, a binding system, a stapling system, or a folding system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, media type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine useful with the present invention, e.g. the NEXPRESS 3000SE printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. As used herein, clear toner is considered to be a color of toner, as are C, M, Y, K, and Lk (light black), but the term "colored toner" excludes clear toners. The provision of a clear-toner overcoat to a color print is desirable for providing protection of the print from fingerprints and reducing certain visual artifacts. Clear toner uses particles that are similar to the toner particles of the color toners but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective toners are deposited one upon the other at respective locations on the receiver and the height of a respective toner stack is the sum of the toner heights of each respective color. Uniform stack height provides the print with a more even or uniform gloss.

FIG. 1 is an elevational cross-section showing portions of a typical electrophotographic printer 100 useful with various embodiments. Printer 100 is adapted to produce print images, such as single-color (monochrome), CMYK, or hexachrome (six-color) images, on a receiver (multicolor images are also known as "multi-component" images). Images can include text, graphics, photos, and other types of visual content. One embodiment of the invention involves printing using an electrophotographic print engine having six sets of single-color image-producing or -printing stations or modules arranged in tandem, but more or fewer than six colors can be combined to form a print image on a given receiver. Other electrophotographic writers or printer apparatus can also be included. Various components of printer 100 are shown as rollers; other configurations are also possible; including belts.

Referring to FIG. 1, printer 100 is an electrophotographic printing apparatus having a number of tandemly-arranged electrophotographic image-forming printing modules 31, 32, 33, 34, 35, 36, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film.

Each printing module 31, 32, 33, 34, 35, 36 includes various components. For clarity, these are only shown in printing module 32. Around photoreceptor 25 are arranged, ordered by the direction of rotation of photoreceptor 25, charger 21, exposure subsystem 22, and development station 23.

In the EP process, an electrostatic latent image is formed on photoreceptor 25 by uniformly charging photoreceptor 25 and then discharging selected areas of the uniform charge to yield an electrostatic charge pattern corresponding to the desired image (a "latent image"). Charger 21 produces a uniform electrostatic charge on photoreceptor 25 or its surface. Exposure subsystem 22 selectively image-wise discharges photoreceptor 25 to produce a latent image. Exposure subsystem 22 can include a laser and raster optical scanner (ROS), one or more LEDs, or a linear LED array.

After the latent image is formed, charged toner particles are brought into the vicinity of photoreceptor 25 by development station 23 and are attracted to the latent image to develop the latent image into a visible image. Note that the visible image may not be visible to the naked eye depending on the composition of the toner particles (e.g. clear toner). Development station 23 can also be referred to as a toning station. Toner can be applied to either the charged or discharged parts of the latent image. The former is referred to as charged-area development (CAD) or write-white, and the latter is referred to as discharged-area development (DAD) or write-black.

After the latent image is developed into a visible image on photoreceptor 25, a suitable receiver 42 is brought into juxtaposition with the visible image. In transfer subsystem 50, a suitable electric field is applied to transfer the toner particles of the visible image to receiver 42 to form the desired print image 38 on the receiver, as shown on receiver 42A. The imaging process is typically repeated many times with reusable photoreceptors 25. In various embodiments, such as those discussed below, a cleaning system is arranged along photoreceptor 25 between transfer subsystem 50 and charger 21 to prepare the photoreceptor for each successive image.

Receiver 42A is then removed from its operative association with photoreceptor 25 and subjected to heat or pressure to permanently fix ("fuse") print image 38 to receiver 42A. Plural print images, e.g. of separations of different colors, are overlaid on one receiver before fusing to form a multi-color print image 38 on receiver 42A.

Each receiver, during a single pass through the six printing modules, can have transferred in registration thereto up to six single-color toner images to form a pentachrome image. As used herein, the term "hexachrome" implies that in a print image, combinations of various of the six colors are combined to form other colors on receiver 42 at various locations on receiver 42. That is, each of the six colors of toner can be combined with toner of one or more of the other colors at a particular location on receiver 42 to form a color different than the colors of the toners combined at that location. In an embodiment, printing module 31 forms black (K) print images, printing module 32 forms yellow (Y) print images, printing module 33 forms magenta (M) print images, printing module 34 forms cyan (C) print images, printing module 35 forms light-black (Lk) images, and printing module 36 forms clear images. In another embodiment, four of the printing modules form C, M, Y, and K print images, and the remaining two printing modules form light cyan (Lc) and light magenta (Lm) print images.

In various embodiments, printing module 36 forms print image 38 using a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42A is shown after passing through printing module 36. Print image 38 on receiver 42A includes unfused toner particles.

Subsequent to transfer of the respective print images, overlaid in registration, one from each of the respective printing modules 31, 32, 33, 34, 35, 36, receiver 42A is advanced to a fuser 60, i.e. a fusing or fixing assembly, to fuse print image 38 to receiver 42A. Transport web 81 transports the print-image-carrying receivers to fuser 60, which fixes the toner particles to the respective receivers by the application of heat and pressure. The receivers are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing member 62, e.g., a roller, and an opposing pressure member 64, e.g., a roller, that form a fusing nip 66 therebetween. In an embodiment, fuser 60 also includes a release fluid application substation 68 that applies release fluid, e.g. silicone oil, to fusing member 62. Alternatively, wax-containing toner can be used without applying release fluid to fusing member 62. Other embodiments of fusers, both contact and non-contact, can be employed with various embodiments. For example, solvent fixing uses solvents to soften the toner particles so they bond with the receiver. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers (e.g., receiver 42B) carrying the fused image (e.g., fused image 39) are transported in a series from the fuser 60 along a path either to a remote output tray 69, or back to printing modules 31, 32, 33, 34, 35, 36 to create an image on the backside of the receiver (e.g., receiver 42B), i.e. to form a duplex print. Receivers (e.g., receiver 42B) can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various media-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Various parameters of the components of a printing module (e.g., printing module 31) can be selected to control the operation of printer 100. In an embodiment, charger 21 is a corona charger including a grid (not shown) between the corona wires (not shown) and photoreceptor 25. Source 21*a* applies a voltage to the corona wire(s) to raise them to a high enough voltage with respect to photoreceptor 25 to ionize the air and create electrostatic charge. Source 21*a* also applies a voltage to the grid to control the charging of photoreceptor 25. Some of the charge from the corona wires is deposited upon the photoreceptor, with the grid acting as a control gate. After a point on photoreceptor 25 is charged, it passes to development station 23. Source 23*a* applies a voltage bias to development station 23 to control the electric field, and thus the rate of toner transfer, from development station 23 to photoreceptor 25. In an embodiment, a voltage is applied to a conductive base layer of photoreceptor 25 by source 25*a* before development, that is, before toner is applied to photoreceptor 25 by development station 23. The applied voltage can be zero; the base layer can be grounded. This also provides control over the rate of toner deposition during development. In an embodiment, the exposure applied by exposure subsystem 22 to photoreceptor 25 is controlled by LCU 99 to produce a latent image corresponding to the desired print image. These parameters can be changed, as described below.

Further details regarding printer 100 are provided in U.S. Pat. No. 6,608,641, issued on Aug. 19, 2003, to Peter S. Alexandrovich et al., and in U.S. Publication No. 2006/0133870, published on Jun. 22, 2006, by Yee S. Ng et al., the disclosures of which are incorporated herein by reference.

○ ○ ○

Figure 9:
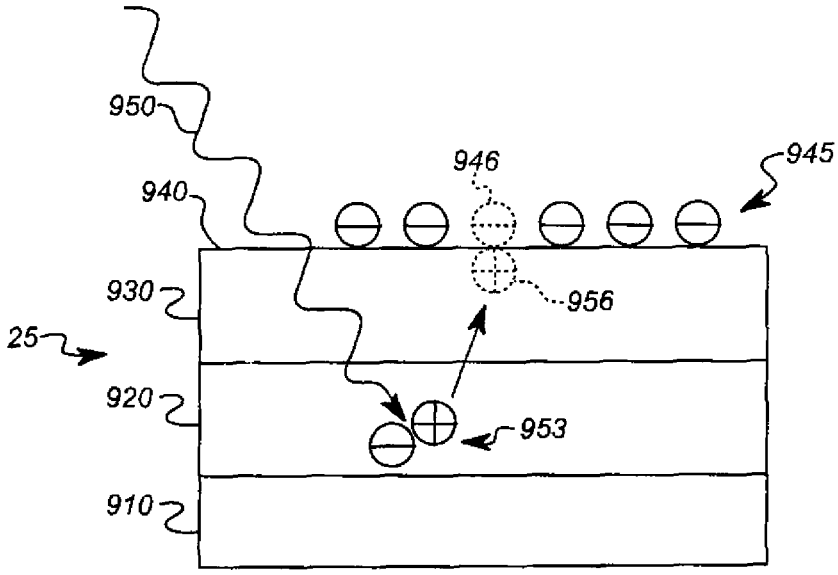
FIG. 9 shows a cross-section of a photoreceptor.

FIG. 9 shows a cross-section of photoreceptor 25. The layers are not shown to scale. Conducting support 910 has layered on it charge-generation layer 920, in which photons are converted to electron-hole pairs. Charge-generation layer 920 includes photoconductive material responsive to actinic radiation. Charge-transport layer 930 permits mobile charge carriers (either the electrons or the holes, but not both) to travel through to surface 940 of photoreceptor 25. When the charge carriers reach surface 940, they dissipate charge 945 previously applied thereto by charger 21 (FIG. 1). Further details of photoreceptors are found in U.S. Pat. No. 4,471,039, issued Sep. 11, 1984, to Borsenberger et al., the disclosure of which is incorporated herein by reference.

In an embodiment, conducting support 910 is connected to ground potential. Charge-transport layer 930 is a hole-transport layer that permits holes to travel from charge-generation layer 920 to the surface 940. Photon 950 generates electron-hole pair 953 in charge-generation layer 920. Hole 956 travels through charge-transport layer 930 and recombines with electron 946 in charge 945, neutralizing that portion of charge 945.

Figure 2:
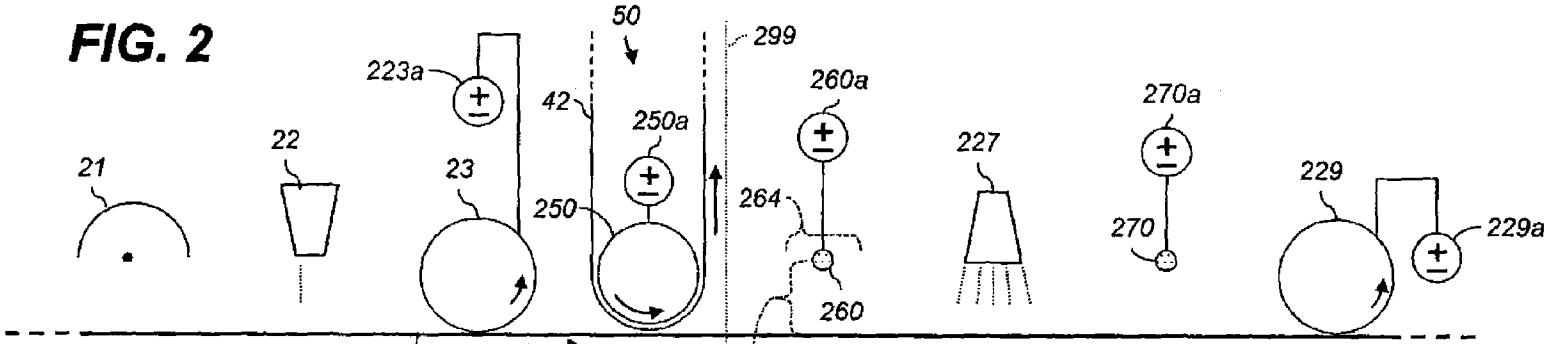
FIG. 2 shows apparatus for preparing a photoreceptor.

FIG. 2 shows apparatus for preparing a photoreceptor. For clarity, a portion of a belt photoreceptor 25 is shown here. Drum photoreceptors, e.g., as shown in FIG. 1, can also be used. Adjacent to photoreceptor 25, in operative arrangement therewith, are charger 21, development station 23, transfer member 250, e.g., a roller, in transfer subsystem 50, erase lamp 227, and cleaning station 229, in order around or along photoreceptor 25 in the direction of rotation thereof. In the example shown, charger 21 is a corona charger with an electrode and a shield. Exposure subsystem 22 selectively image-wise discharges photoreceptor 25 to produce a latent image. Development station 23 applies toner to form a visible image on photoreceptor 25. Source 223*a* applies a bias to development station 23 to encourage transfer. Transfer member 250 (part of transfer subsystem 50, describe above with reference to FIG. 1) presses receiver 42 against photoreceptor 25 to transfer the visible image from photoreceptor 25 to form the print image on receiver 42. Source 250*a* biases transfer member 250 so that an electric field is created that drives toner particles towards receiver 42. Erase lamp 227 is a source of actinic radiation to erase remaining charge in the latent image on photoreceptor 25. In the example shown, cleaner 229 is a roller cleaner to which a bias is applied by source 229*a*.

First corona electrode 260 is disposed within 3 cm of the surface of the photoreceptor 25, but not in contact therewith, as represented by spacing 262. First corona electrode 260 is arranged between transfer subsystem 50 and erase lamp 227. First corona electrode 260 extends at most 0.5 cm in either direction along the photoreceptor in the circumferential (in-track) direction thereof. That is, transfer subsystem 50 and erase lamp 227 are less than 2 cm apart, or at most 1 cm apart. This is represented by spacing 264. In contrast, a prior-art corona charger can require at least 1 cm on each side to avoid breakdown between the corona electrode and its surrounding shield. Source 260*a* provides AC or DC bias to first corona electrode 260.

Second corona electrode 270 is also disposed within 3 cm of the surface of photoreceptor 25, but not in contact therewith, and is located between erase lamp 227 and cleaning station 229. Second corona electrode 270 extends at most 0.5 cm in either direction along the in-track direction of photoreceptor 25. That is, erase lamp 227 and cleaning station 229 are at most 1 cm apart. Source 270*a* provides AC or DC bias to second corona electrode 270.

In various embodiments, first corona electrode 260 and second corona electrode 270 include an electrically-conductive support and a plurality of conductive fibers, each attached by only one of its ends to the support. In an example, the fibers stick out from the support, which is a static string. The support can include conductive adhesive to attach the fibers to the support, or the fibers can be woven into the support. The fibers are electrically connected together, and biasable at one or both ends of the electrode. The support can be electrically conductive, or the fibers can be electrically connected down the length of the electrode by an electrically-conductive member, and the support can be insulating, e.g., woven of insulative fiber. The fibers can be parallel or not. For example, corona electrodes 260, 270 can be fiber strings or fiber brushes. The fibers can be stainless steel. An example of a conductive cord useful with various embodiments is given in U.S. Pat. No. 5,690,014, issued Nov. 25, 1997, to Larkin, the disclosure of which is incorporated herein by reference. Various electrodes useful with embodiments are referred to as "static strings" or "string chargers." In various embodiments, no grid is interposed or positioned between first corona electrode 260 and photoreceptor 25. In various embodiments, no grid is interposed or positioned between second corona electrode 270 and photoreceptor 25.

Figure 3:
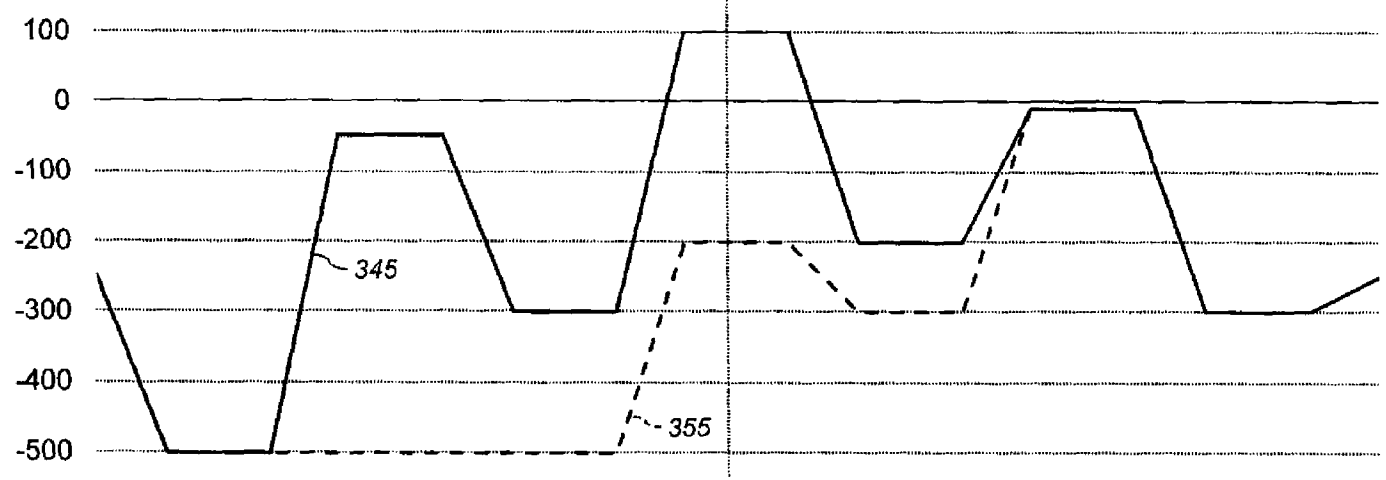
FIG. 3 shows an example of the potential of a point on the surface of the photoreceptor as it moves through the EP process.

FIG. 3 shows a hypothetical example of the potential of a point on the surface of the photoreceptor as it moves through the EP process, including photoreceptor preparation processes described herein. This example is for a discharged-area-development (DAD or "write-black") process. Curve 345 (solid) shows potentials for a point that is exposed by exposure subsystem 22. Curve 355 (dashed) shows potentials for a point that is not exposed by exposure subsystem 22. This example is for a binary-halftoning system, one in which each pixel is exposed or not (neglecting crosstalk). FIG. 3 is scaled horizontally to match FIG. 2. FIG. 3 therefore shows an example of potentials as the point moves through the apparatus described in FIG. 2, described above. The abscissa therefore shows position on photoreceptor 25 (FIG. 2). The ordinate shows voltage at the selected point on photoreceptor 25 with respect to ground potential. Components of FIG. 2 and points in FIG. 3 to the left of reference line 299 can be considered part of the printing process. Components and points to the right of reference line 299 can be considered part of the photoreceptor-preparation process. However, the steps for printing and for photoreceptor preparation can be rearranged or interleaved. Reference line 299 is provided only for clarity of understanding the embodiment(s) shown, and is not limiting. As discussed above, photoreceptor preparation includes electrical reconditioning and mechanical reconditioning.

Referring to FIG. 3 and also to FIG. 2, in this example, charger 21 charges a selected active area of photoreceptor 25 with charge of a selected polarity (sign) to a selected surface potential using the charger. In this example, the polarity is negative and the surface potential is −500V. The active area can exclude areas not used for imaging, e.g., photoreceptor belt seams or margins.

Exposure subsystem 22 image-wise exposes photoreceptor 25 so that the potential of the portions of the photoreceptor that are exposed is reduced in magnitude to (in this example) −50V. Toner will be attracted to these portions in the next step since this is an example of a DAD process. Unexposed areas remain at −500V.

Development station 23 selectively applies toner to the exposed portions of the active area. The toner is negatively-charged. Source 223*a* applies a DC bias of −400V to development station 23 to produce a potential gradient between development station 23 and photoreceptor 25. The negatively-charged toner follows the potential gradient from the development station 23 at −400V down to the exposed areas at −50V. Toner is kept off the unexposed areas by the potential gradient from the unexposed areas at −500V to development station 23 at −400V. After toning, the exposed, toned areas are at −300V and the unexposed areas are still at −500V, neglecting dark decay.

Transfer member 250 is on the opposite side of receiver 42 from photoreceptor 25 and has a bias of +2000V for direct transfer from photoreceptor 25 to receiver 42. The bias is applied by source 250*a*. (In another example, for transfer to an intermediate instead of directly to the receiver, a lower voltage such as +500V can be used since the impedance in the transfer nip is lower when a receiver 42 is not in the transfer nip.) As a result of the +2000V bias, negatively-charged toner is drawn by Lorentz forces from photoreceptor 25 (at −300V) toward receiver 42. Not all toner necessarily transfers to receiver 42. For example, some toner has surface forces holding toner to photoreceptor 25 that are stronger than the Lorentz forces pulling toner toward receiver 42. This will be discussed further below. After toner is removed from photoreceptor 25, the photoreceptor disengages from transfer member 250. As photoreceptor 25 separates from transfer member 250, the decreasing capacitance associated with the opening air gap between photoreceptor 25 and transfer member 250 can result in the electric field between the two exceeding the Paschen limit, thereby producing post-nip ionization (air breakdown) within the air gap. This ionization showers positive charge on photoreceptor 25. As a result, the areas of photoreceptor 25 from which the toner was removed are at +100V. The unexposed areas are at −200V. Any areas on which toner still remains are at +50V.

In prior schemes, erase lamp 227 irradiates the active area of photoreceptor 25 immediately after transfer. Erasing reduces the electrostatic force of attraction on residual toner on photoreceptor 25 by reducing the magnitude of the potential on the surface of photoreceptor 25. As discussed above with reference to FIG. 9, in an example, the erase-lamp radiation causes electron-hole pairs to be formed in the charge-generation layer of the photoreceptor, and the holes travel through a hole-transport layer to the surface of the photoreceptor. At the surface, the excess electrons producing the −200V present in unexposed areas on the surface of the photoreceptor recombine with the holes and become neutralized. The remaining electrons in the charge-generation layer dissipate through the ground connection at the bottom of the photoreceptor. However, in the exposed, toned areas carrying a positive bias (here, +100V), the electrons are drawn from the charge-generation layer towards the holes on the surface by the electrostatic force between the positive charges on the surface and the negative charge on the newly-generated electrons. These electrons become trapped in hole-transport layer 930 (FIG. 9) because this layer transports holes, not electrons. These electrons thus form trapped charges in the hole-transport layer, and can result in ghost-image formation since areas containing trapped electrons will be charged less efficiently by the primary charger. This can result in image-wise non-uniformity.

In order to solve this problem, a first bias potential, e.g., −2000 VDC (or −1 kVDC to −3 kVDC) is applied to the first corona electrode 260 to charge the photoreceptor. Exposed areas are charged to −200V. Unexposed areas are charged to −300V. Consequently, the surface of the photoreceptor does not contain substantial areas of positive charge during the erase step. This greatly reduces the trapping of negative charge in the hole-transport layer, as described above.

First corona electrode 260 can also charge toner remaining in the active area after transfer to a charge of the selected polarity. In this way, little or no wrong-sign residual toner is left in the active area. Positive charge on the toner is neutralized by the negative charge showered from first corona electrode 260. This can be performed at a much lower potential with first corona electrode 260 than with a straight corona wire because first corona electrode 260 has a plurality of sharp points at smaller effective diameters (as compared to a straight corona wire) that go into corona and produce currents at lower-magnitude relative voltages. Consequently, first corona electrode 260 only uses a −1 to −3 kV bias, compared to −5 kV or more negative than −5 kV with a straight corona wire.

As photoreceptor 25 is irradiated in the active area with the erase lamp 227, the surface potentials of exposed areas is reduced in magnitude to −10V, as described above. The surface potentials of unexposed areas, which have been charged negatively by first corona electrode 260, are also reduced in magnitude to −10V.

After erase, there is a non-zero probability that some charge is still trapped in charge-generation layer 920 or charge-transport layer 930 (both FIG. 9) of photoreceptor 25. In order to reduce the formation of ghost images by this wrong-sign charge, a second bias (e.g., −1 kVDC to −3 kVDC) is applied to second corona electrode 270. The first and second biases can be the same or different. As discussed above, second corona electrode 270 showers the surface of photoreceptor 25 with negative charge to drive, by Coulombic repulsion, trapped negative charges in the hole-transport layer back into the charge-generation layer or out through the photoreceptor ground. This shower of negative charge also increases the magnitude of the surface potential of photoreceptor 25 in the active area.

The photoreceptor has now been substantially electrically reconditioned. To mechanically recondition the photoreceptor, a third bias, here e.g., +100V with respect to the surface of the photoreceptor, is applied to cleaning station 229 by source 229*a*. This bias produces an electric field that exerts a selected force away from photoreceptor 25 on toner particles in the active area. As a result, toner is removed from the active area of photoreceptor 25. In this example, the +100V bias creates a potential gradient from the photoreceptor at −300V toward the cleaning station at +100V, and the negatively-charged toner particles are drawn down the potential gradient to cleaning station 229. After cleaning, the surface of the photoreceptor is at −250V and is prepared for the next cycle, beginning with charging.

Prior systems such as the XEROX IGEN use a patterned exposure but not a uniform erase. Such systems also do not have any component comparable to second corona electrode 270.

Through the remainder of this disclosure, for clarity, the example of FIG. 3 will be used. However, either CAD or DAD processes can be used with embodiments described herein, and toner particles and the photoreceptor can be charged positively or negatively, and with the same or different signs. Applied biases can be positive or negative, as appropriate.

Figure 4:
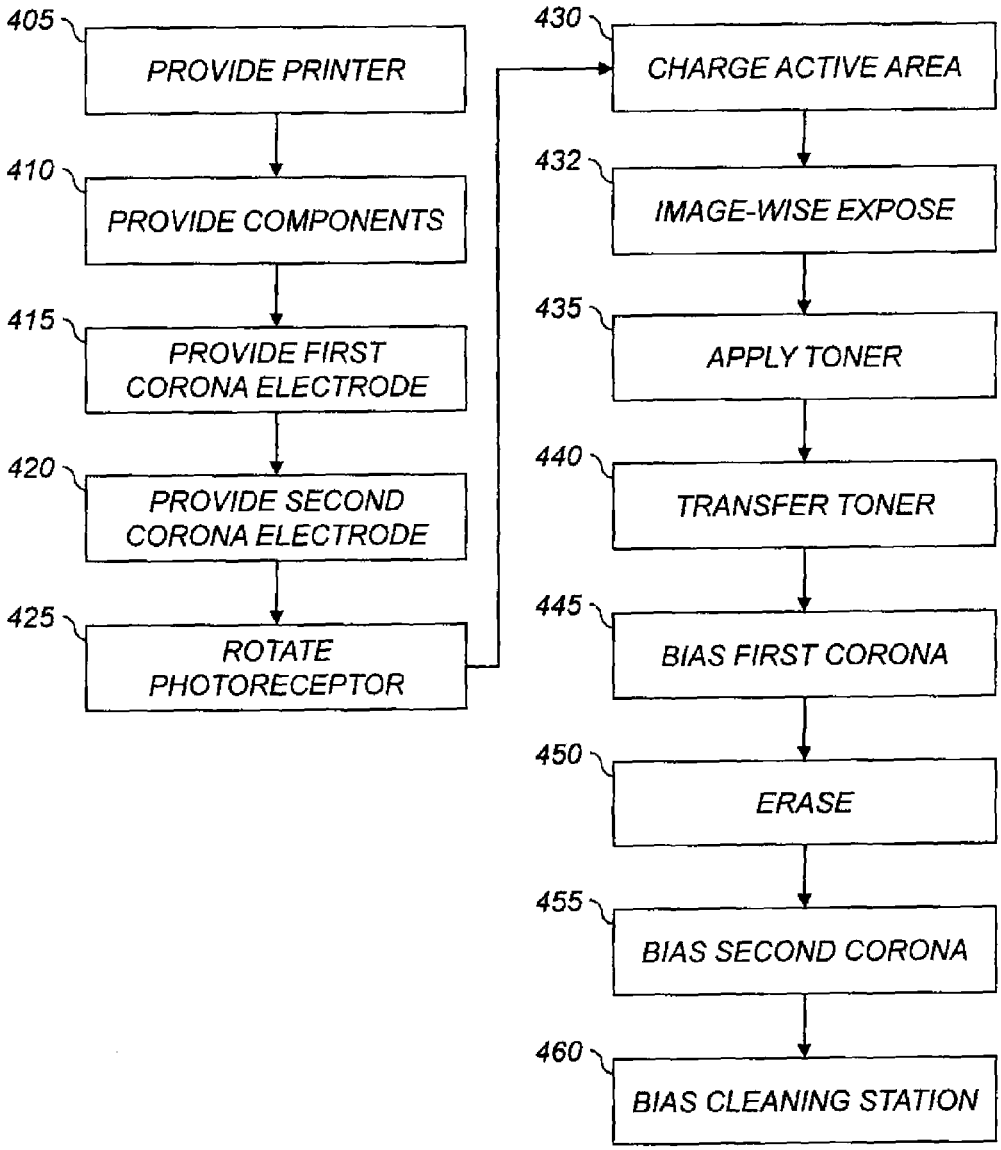
FIGS. 4 and 5 show methods of preparing a rotatable photoreceptor in an electrophotographic (EP) printer.

FIG. 4 shows a method of preparing a rotatable photoreceptor in an electrophotographic (EP) printer. Processing begins with step 405.

In step 405, the EP printer having the rotatable photoreceptor is provided. FIG. 2, above, shows an example of components of an EP printer useful with various embodiments. Step 405 is followed by step 410.

In step 410, a charger, a development station, a transfer station, an erase lamp, and a cleaning station are provided. These components are arranged in this order around or along the photoreceptor in the direction of rotation thereof. Step 410 is followed by step 415.

In step 415, a first corona electrode is provided. The first corona electrode is disposed within 3 cm of the surface of the photoreceptor, but is not in mechanical contact with it. The first corona electrode is located between the transfer station and the erase lamp. The corona electrode extends at most 0.5 cm, or less than 1 cm, in either direction along the photoreceptor, i.e., along the in-track direction of the photoreceptor. That is, the transfer station and the erase lamp can be less than 2 cm apart, 1 cm apart, or at most 1 cm apart, and still leave room for the first corona electrode between them. By comparison, some prior schemes describe corona chargers with at least 1 cm of space on each side to avoid breakdown, so that the transfer station and the erase lamp are at least 2 cm apart. The breakdown voltage of typical air is approximately 3 MV/m, or 30 kV/cm. Typical corona chargers use corona wires with diameters ranging from 40 μm to 150 μm. DC voltages of at least 3.5 kV in magnitude are applied to such wires to achieve air breakdown and the onset of a DC corona. Generation of DC current at levels sufficient for re-charging of photoreceptor surfaces requires DC voltage magnitudes in the range of 4-6 kV. At these voltages, there is a significant probability of arcing from the wire to the charger body at a corona-electrode-to-body spacing less than 1 cm. However, with corona electrodes such as those containing conductive brushes or fibers having tip diameters less than 40 micrometers, the onset and production of useful DC corona currents occurs at DC voltages less than 3.5 kV in magnitude, thereby reducing the corona electrode-to-body spacing required to avoid arcing. Step 415 is followed by step 420.

In step 420, a second corona electrode is provided. It is disposed within 3 cm of the surface of the photoreceptor, but is not in contact therewith, and is located between the erase lamp and the cleaning station. The second corona electrode extends at most 0.5 cm along the photoreceptor, as described above. Step 420 is followed by step 425.

In step 425, the photoreceptor is rotated. While it rotates, steps 430-460 are performed in order. Step 425 is followed by step 430.

In step 430, a selected active area of the photoreceptor is charged with charge of a selected polarity (also referred to as a selected sign, i.e., + or −) to a selected surface potential using the charger. Step 430 is followed by step 432.

In step 432, the photoreceptor is image-wise exposed to reduce the magnitude of surface charge in the exposed portions of the active area using the exposure subsystem. This forms a patterned latent image on the photoreceptor. Step 432 is followed by step 435.

In step 435, toner is selectively applied to the active area using the development station, e.g., as described above with respect to development station 23 (FIGS. 1, 2). This forms a print image. Step 435 is followed by step 440.

In step 440, some of the applied toner is transferred from the active area to a receiver. Although it is desirable that all the image toner be transferred, it can be the case that some is left on the photoreceptor. As a result, the photoreceptor needs to be cleaned and electrically reconditioned. Step 440 is followed by step 445.

In step 445, the preparation process begins. A first bias is applied to the first corona electrode to charge the photoreceptor to a selected pre-erase potential of the same polarity as the selected surface potential in the active area. This charging process discharges residual surface charge of the opposite sign of the toner. Step 445 is followed by step 450.

In step 450, the photoreceptor is irradiated in the active area using the erase lamp to produce a neutralizing charge of the opposite polarity to that found on the surface of the photoreceptor after step 445 in the active area. Step 450 is followed by step 455.

In step 455, a second bias is applied to the second corona electrode to charge toner remaining in the active area after transfer (step 440) to a charge of the selected polarity. Since toner will be removed from the photoreceptor electrostatically in step 460, as described below, this step charges toner particles so they will be attracted electrostatically away from the photoreceptor. Charging from the second bias also increases the magnitude of the surface potential of the photoreceptor in the active area. This provides an electric field within the photoconductor which enables the mobilization and neutralization of trapped charge. Step 455 is followed by step 460.

In step 460, a third bias is applied to the cleaning station to produce an electric field that exerts a selected force away from the photoreceptor on toner particles in the active area. As a result, toner is removed from the active area of the photoreceptor.

An example of a cleaner useful with various embodiments is given in commonly-assigned U.S. Pat. No. 5,937,254, issued Aug. 10, 1999, to Maher et al., which is incorporated herein by reference.

In various embodiments, the cleaner includes a detone roller and a rotating fiber cleaning brush that contacts and scrubs the photoreceptor to remove unwanted particulates. The rotating detone roller has an electrically-conductive surface in contact with the fibers of the fiber cleaning brush. The detone roller including a first permanent magnet located beneath the conductive surface for attracting escaped carrier particles to the detone roller, and the conductive surface of the detone roller is under electrical bias to electrostatically attract toner particles to the conductive surface. A skive blade of magnetic material engages the conductive surface, and a second permanent magnet located beneath the conductive surface and near the skive blade attracts the skive blade to the conductive surface so that the skive blade can effectively remove toner particles and carrier particles from the conductive surface.

In other embodiments, other cleaning technologies are used. Examples include a vacuum fur brush, a scraper, or a wiper blade. The wiper blade can be used with neutral or nearly-neutral toner particles.

Figure 5:
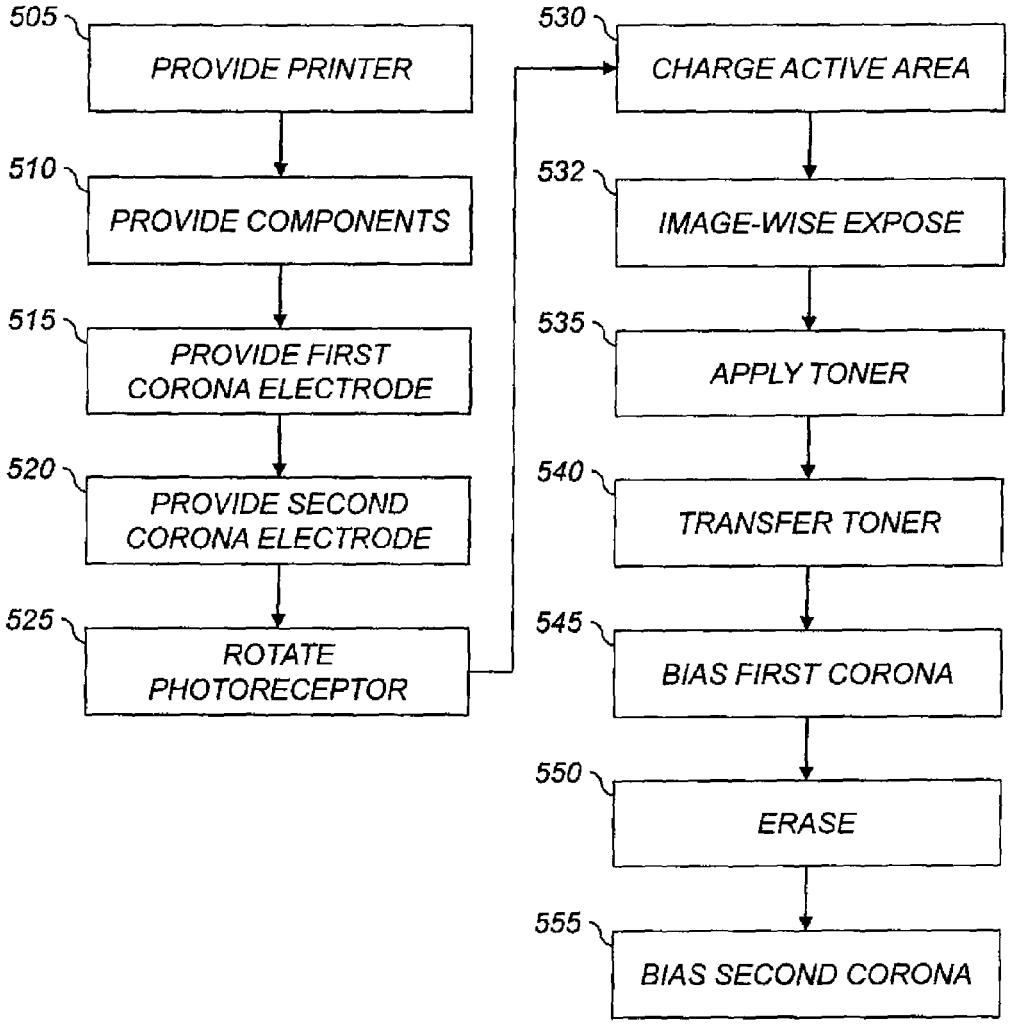

FIG. 5 shows a method of preparing a rotatable photoreceptor in an electrophotographic (EP) printer. Processing begins with step 505.

In step 505, the EP printer having the rotatable photoreceptor is provided. Step 505 is followed by step 510.

In step 510, a charger, a development station, an erase lamp, and a blade cleaner are provided. These components are arranged in this order around or along the photoreceptor in the direction of rotation thereof. Step 510 is followed by step 515.

In step 515, a first corona electrode disposed within 3 cm of the surface of the photoreceptor, but not in contact therewith, is provided between the development station and the erase lamp. The transfer station and the erase lamp are less than 2 cm apart, or at most 1 cm apart, as discussed above. Step 515 is followed by step 520.

In step 520, a second corona electrode disposed within 3 cm of the surface of the photoreceptor, but not in contact therewith, is provided between the erase lamp and the blade cleaner. The erase lamp and the blade cleaner are less than 2 cm apart, or at most 1 cm apart. Step 520 is followed by step 525.

In step 525, the photoreceptor is rotated. While it rotates, steps 530-555 are performed in order. Step 525 is followed by step 530.

In step 530, a selected active area of the photoreceptor is charged with charge of a selected polarity (sign) to a selected surface potential using the charger. Step 530 is followed by step 532.

In step 532, the photoreceptor is image-wise exposed to reduce the magnitude of surface charge in the exposed portions of the active area using the exposure subsystem. Step 532 is followed by step 535. The magnitude of surface charge is reduced in both CAD and DAD systems.

In step 535, toner is selectively applied to the active area using the development station. Step 535 is followed by step 540.

In step 540, some of the applied toner is transferred from the active area to a receiver. Some can be left; if any is left in the active area, it is to be cleaned off. Step 540 is followed by step 545.

In step 545, a first bias is applied to the first corona electrode to charge the photoreceptor to a selected pre-erase potential of the same polarity as the selected surface potential in the active area. Step 545 is followed by step 550.

In step 550, the photoreceptor is irradiated in the active area using the erase lamp to produce a neutralizing charge in the active area. This can also reduce the electrostatic force of attraction between toner and the photoreceptor. Step 550 is followed by step 555.

In step 555, a second bias is applied to the second corona electrode to increase the magnitude of the surface potential of the photoreceptor in the active area. This reduces the probability of creation of trapped charge. As a result, when the active area passes the blade cleaner, toner is dislodged from the active area of the photoreceptor by the blade cleaner.

Figure 6:
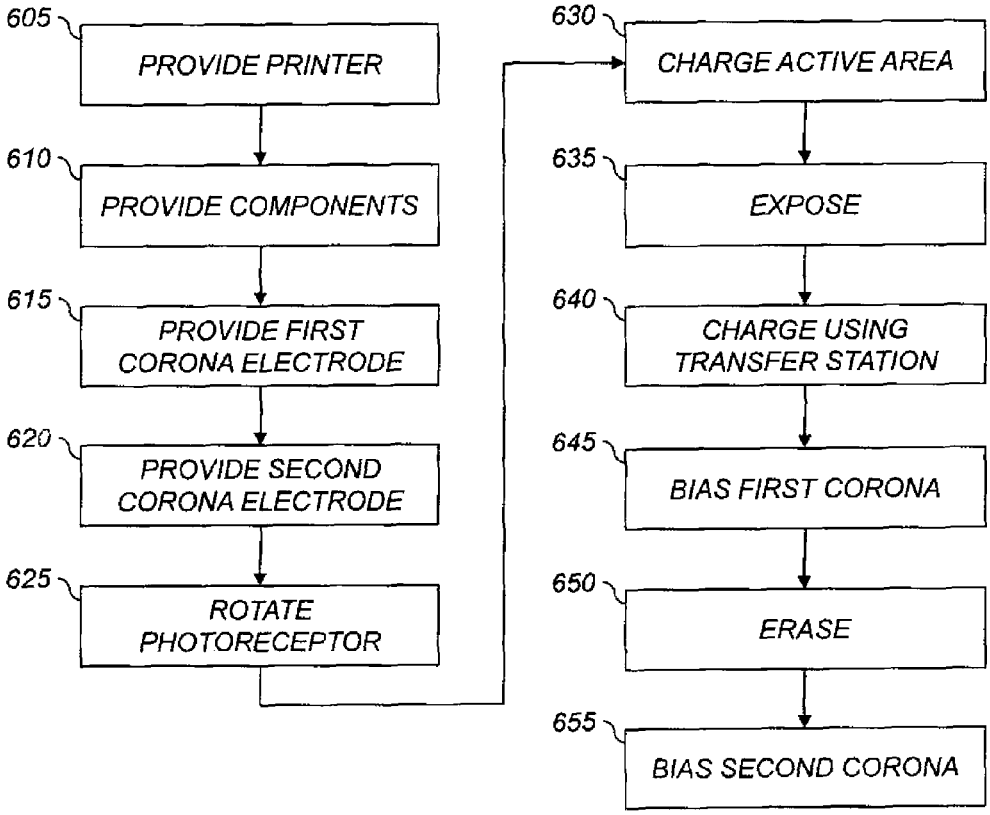
FIG. 6 shows a method of electrically reconditioning a rotatable photoreceptor in an electrophotographic (EP) printer.

FIG. 6 shows a method of electrically reconditioning a rotatable photoreceptor in an electrophotographic (EP) printer. Processing begins with step 605.

In step 605, the EP printer having the rotatable photoreceptor is provided. Step 605 is followed by step 610.

In step 610, a charger, an exposure subsystem, a transfer station, and an erase lamp are provided. These components are arranged in this order around or along the photoreceptor in its direction of rotation. Step 610 is followed by step 615.

In step 615, a first corona electrode disposed within 3 cm of the surface of the photoreceptor, but not in contact therewith, is provided between the transfer station and the erase lamp. As discussed above, the transfer station and the erase lamp are less than 2 cm apart, or at most 1 cm apart. Step 615 is followed by step 620.

In step 620, a second corona electrode disposed within 3 cm of the surface of the photoreceptor, but not in contact therewith, is provided after the erase lamp in the direction of rotation of the photoreceptor. The erase lamp and the second corona electrode are less than 2 cm apart, or at most 1 cm apart along the in-track direction of the photoreceptor. Step 620 is followed by step 625.

In step 625, the photoreceptor is rotated. While it rotates, steps 630-655 are performed in order. Step 625 is followed by step 630.

In step 630, a selected active area in which the image is to be produced of the photoreceptor is charged with charge of a selected polarity (sign) to a selected surface potential using the charger. Step 630 is followed by step 635.

In step 635, the photoreceptor is exposed to actinic radiation by the exposure subsystem to reduce the magnitude of surface charge in the active area. Step 635 is followed by step 640.

In step 640, the photoreceptor is charged by the transfer station. As discussed above, the transfer station showers charge on the exiting photoreceptor because of post-nip ionization. Step 640 is followed by step 645.

In step 645, a first bias is applied to the first corona electrode to charge the photoreceptor to a selected pre-erase potential of the same polarity as the selected surface potential in the active area. This discharges wrong-sign charge. Step 645 is followed by step 650.

In step 650, the photoreceptor is irradiated in the active area using the erase lamp to produce a neutralizing charge in the active area. Step 650 is followed by step 655.

In step 655, a second bias is applied to the second corona electrode to increase the magnitude of the surface potential of the photoreceptor in the active area. As a result, at least some of the trapped charges in the photoreceptor are removed.

As a result of this process, the active area of the photoreceptor is placed in an initialized electrical state having a stable surface potential with little trapped charge. The voltage across the active area can be uniform or have small fluctuations; the fluctuations are preferably smaller than the voltage difference between adjacent exposure levels when producing an image (whether by binary or multi-level writing). This condition is similar to the condition of the photoreceptor after printing a blank image, i.e., one in which no toner is deposited or intended to be deposited on the receiver.

In various embodiments, step 635 includes exposing the entirety of the active area to actinic radiation at an exposure that would produce $D_{max}$ black in a DAD system or $D_{min}$ white in a CAD system. In other embodiments, step 635 is not used, and no exposure takes place.

Figure 7:
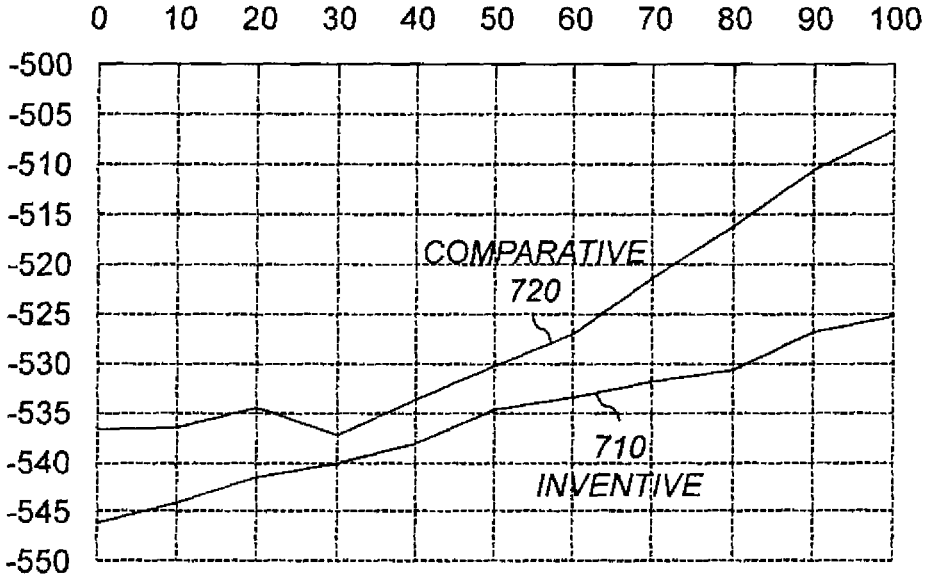
FIGS. 7-8 show examples of the performance of a tested cleaning system compared to prior systems.
Figure 8:
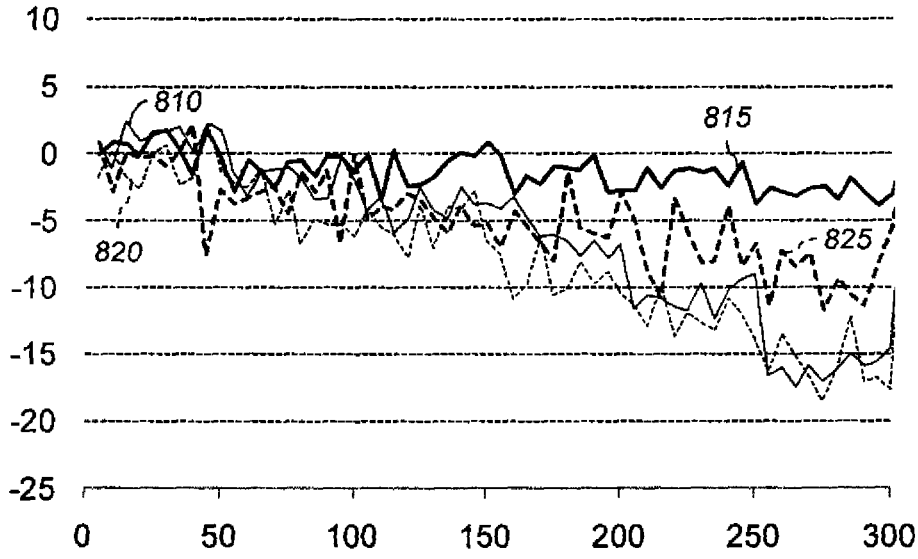

FIGS. 7-8 show examples of the performance of a tested electrical reconditioning system compared to prior systems. The tested system used a process in which a photoreceptor was charged to a predetermined surface potential using a gridded charger, then irradiated by an LED erase lamp, and finally exposed to a first corona charger having a conductive rod sleeved with static string from ALPHA INNOVATION, spaced approximately 2 mm from the photoreceptor. The rod was biased at −2 kVDC.

FIG. 7 shows measured surface potentials on the photoreceptor after charging in the primary charger (ordinate) as a function of erase level (abscissa; arbitrary units). Erase level is positively correlated to intensity or duty cycle of the erase lamp. Inventive curve 710 displays the dependence of the surface potential on the erase lamp level for a process in which an inventive corona electrode as described herein is used between the erase lamp and the primary charging device. Comparative curve 720 displays the dependence of the surface potential on the erase lamp level for prior schemes. As shown, inventive curve 710, representing the use of an inventive corona electrode, charges the photoreceptor to a higher magnitude of voltage than comparative curve 720, without the corona electrode.

Moreover, in various embodiments, erase levels greater than 30 are used. In these embodiments, inventive curve 710 has a smaller slope than comparative curve 720. That is, these inventive embodiments are less sensitive to erase-level variation than the comparative example. This advantageously provides more consistent electrical-reconditioning performance than the comparative example. This advantage is provided because the inventive corona electrode discharges trapped charges produced in the photoreceptor by the erase lamp. When the inventive corona electrode is not used, these trapped charges discharge to the surface of the photoreceptor over time, in a way similar to the self-discharge of a capacitor over time. This discharge reduces the efficiency of the primary charger and thus the magnitude of surface potential of the photoreceptor, which effects can reduce the imaging performance thereof.

FIG. 8 shows the difference in photoreceptor surface potential between the potential measured immediately after a primary charger and the potential after exposure using an LED array. Four curves are shown, all adjusted to begin at the same value. This permits comparing the trends of the four over time. The abscissa is the cycle number (i.e., the number of revolutions of the photoreceptor). Measurements were taken at two locations across the photoreceptor. The exposure LED array was turned off, so the difference on the ordinate would theoretically be 0 for all the cycle numbers (photoconductor drum revolutions). The solid curves are for sensor 1 and the dashed curves are for sensor 2. The thick-line curves are data taken with the corona electrode and the thin-line curves are data taken without.

Without the corona electrode, as shown by curves 810 (first sensor) and 820 (second sensor), the potential difference increases in magnitude with cycle number. This indicates space charge is being trapped in the photoreceptor. With the corona electrodes, as shown by curves 815 (first sensor) and 825 (second sensor), the differential does not increase in magnitude as much as without the electrode (curves 810, 820), indicating the advantageous effect of the biased corona electrode of reducing the amount of trapped space charge. This reduction is accomplished by recharging the photoreceptor after the erase using second corona electrode 270 (FIG. 2). As discussed above, second corona electrode 270 showers the photoreceptor with negative charge to begin moving holes towards charge-generation layer 920 to recombine with any charges created by erase lamp 227 (FIG. 2) and still left in the photoreceptor. Prior schemes do not begin moving holes (or other charge carriers) until the relevant part of the photoreceptor rotates under the primary charger. In embodiments described herein, more of the charge deposited by the primary charger increases the potential of the photoreceptor, rather than discharging the trapped space charge.

Figure 10:
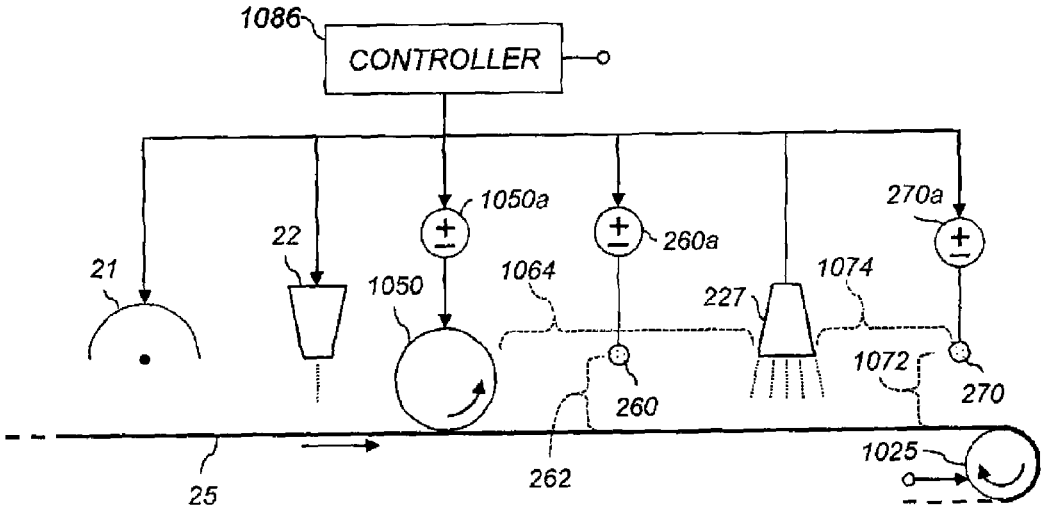
FIG. 10 shows apparatus for electrically reconditioning a rotatable photoreceptor in an electrophotographic (EP) printer according to various embodiments.

FIG. 10 shows apparatus for electrically reconditioning a rotatable photoreceptor in an electrophotographic (EP) printer according to various embodiments. The EP printer includes rotatable photoreceptor 25. Charger 21, exposure subsystem 22, transfer station 1050, and erase lamp 227 are arranged in this order around or along photoreceptor 25 in the direction of rotation thereof. Transfer member 1050 is similar to transfer member 250 shown in FIG. 2, but does not transfer toner to a receiver. No printing is taking place, so no toner needs to be transferred to photoreceptor 25. In this apparatus toner is not used, as toner is not required to electrically recondition photoreceptor 25. In an example, transfer station 1050 is an electrically-biased static-dissipative drum.

First corona electrode 260 is disposed within 3 cm of the surface of photoreceptor 25, but is not in contact with that surface. This is indicated by spacing 262. First corona electrode 260 is located between transfer station 1050 and erase lamp 227. Transfer station 1050 and erase lamp 227 are less than 2 cm apart, or at most 1 cm apart, as indicated by spacing 1064.

Second corona electrode 270 is disposed within 3 cm of the surface of photoreceptor 25, but is not in contact with that surface. This is indicated by spacing 1072. Second corona electrode 270 is located after erase lamp 227 in the direction of rotation of photoreceptor 25. Erase lamp 227 and second corona electrode 270 are less than 1 cm apart, as indicated by spacing 1074.

In various embodiments, additional components are present. Drive 1025 rotates photoreceptor 25. A voltage source is provided for providing biases to corona electrodes 260, 270. In the embodiment shown, the voltage source includes 260*a* and 270*a*. Source 260*a* selectively provides a first bias to first corona electrode 260. Source 270*a* selectively provides a second bias to second corona electrode 270. The biases can be the same or different.

Controller 1086 is a processor or logic device (e.g., LCU 99, FIG. 1) adapted to control the apparatus. First, controller 1086 causes drive 1025 to rotate photoreceptor 25. This control is represented graphically by the circular control points from controller 1086 to drive 1025.

Controller 1086 then causes charger 21 to charge a selected active area of photoreceptor 25 with charge of a selected polarity (sign) to a selected surface potential. The active area preferably includes at least one area in which an image will be produced on photoreceptor 25 during a printing cycle that follows electrical reconditioning.

Controller 1086 then causes exposure subsystem 22 to expose photoreceptor 25 to reduce the magnitude of surface charge in the active area. Exposure is preferably uniform over the entire active area.

Controller 1086 then causes transfer member 1050 to charge photoreceptor 25. Transfer member 1050 is biased by source 1050*a*, which is similar to source 250*a* (FIG. 2). In various embodiments, the same bias is applied by source 1050*a* as that applied by source 250*a* (FIG. 2) to transfer toner to a receiver. In addition to providing an electrical field near photoreceptor 25, as described above, charging is also accomplished by showering charge on photoreceptor 25 due to post-nip ionization as photoreceptor 25 and the surface of transfer member 1050 separate.

Controller 1086 then causes the voltage source (here, source 260*a*) to apply the first bias to first corona electrode 260 to charge photoreceptor 25 to a selected pre-erase potential of a selected polarity. In various embodiments, the pre-erase potential has the same polarity as the selected surface potential in a selected active area of the photoreceptor.

Controller 1086 then causes erase lamp 227 to irradiate photoreceptor 25 in the active area to neutralize charge on the surface of photoreceptor 25 in the active area. This is as discussed above with reference to FIG. 9.

Controller 1086 then causes the voltage source (here, source 270*a*) to apply the second bias to second corona electrode 270 to increase the magnitude of the surface potential of photoreceptor 25 in the active area. This removes trapped charges in photoreceptor 25.

In various embodiments, as discussed above, each of the first and second corona electrodes 260, 270 includes an electrically-conductive support (not shown) and a plurality of conductive fibers (not shown). Each fiber is attached by only one of its ends to the support.

In various embodiments, as discussed above, no grid is positioned between the first or second corona electrode and the photoreceptor.

Figure 11:
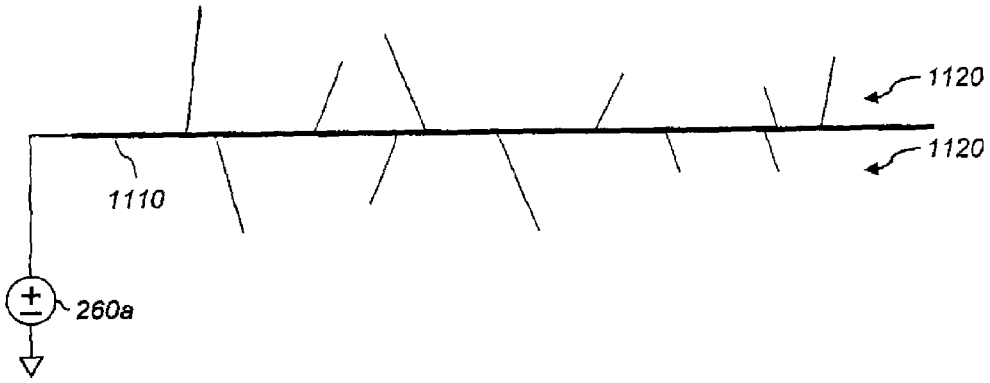
FIG. 11 is a side elevation of an example of a corona electrode according to various embodiments.

FIG. 11 is a side elevation of an example of a corona electrode according to various embodiments. Electrically-conductive support 1110 is biased by source 260*a*. Fibers 1120 are conductive. The lengths and spacings of fibers 1120 are exaggerated for clarity.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

21 charger
21*a* source
22 exposure subsystem
23 development station
23*a* source
25 photoreceptor
25*a* source
31, 32, 33, 34, 35, 36 printing module
38 print image
39 fused image
40 supply unit
42, 42A, 42B receiver
50 transfer subsystem
60 fuser
62 fusing member
64 pressure member
66 fusing nip
68 release fluid application substation
69 output tray
70 finisher
81 transport web
86 cleaning station
99 logic and control unit (LCU)
100 printer
223*a* source
227 erase lamp
229 cleaning station
229*a* source
250 transfer member
250*a* source
260 first corona electrode
Parts Lists—Continued
260*a* source
262, 264 spacing
270 second corona electrode
270*a* source
299 reference line
345 curve
355 curve

405 provide printer step
410 provide components step
415 provide first corona electrode step
420 provide second corona electrode step
425 rotate photoreceptor step
430 charge active area step
432 image-wise expose step
435 apply toner step
440 transfer toner step
445 bias first corona step
450 erase step
455 bias second corona step
460 bias cleaning station step
505 provide printer step
510 provide components step
515 provide first corona electrode step
520 provide second corona electrode step
525 rotate photoreceptor step
530 charge active area step
532 image-wise expose step
535 apply toner step
540 transfer toner step
545 bias first corona step
Parts Lists—Continued
550 erase step
555 bias second corona step
605 provide printer step
610 provide components step
615 provide first corona electrode step
620 provide second corona electrode step
625 rotate photoreceptor step
630 charge active area step
635 expose step
640 charge using transfer station step
645 bias first corona step
650 erase step
655 bias second corona step
710 inventive curve
720 comparative curve
810, 815, 820, 825 curve
910 conducting support
920 charge-generation layer
930 charge-transport layer
940 surface
945 charge
946 electron
950 photon
953 electron-hole pair
956 hole
1025 drive
1050 transfer member
1050*a* source
1064, 1072, 1074 spacing
1086 controller
Parts Lists—Continued
1110 support
1120 fiber

The invention claimed is:

1. Apparatus for electrically reconditioning a rotatable photoreceptor in an electrophotographic (EP) printer, comprising:

a) the EP printer having the rotatable photoreceptor;

b) a charger, an exposure subsystem, a transfer station, and an erase lamp arranged in that order around the photoreceptor in the direction of rotation thereof;

c) a first corona electrode disposed within 3 cm of a surface of the photoreceptor, but not in contact therewith, between the transfer station and the erase lamp, the transfer station and the erase lamp being less than 2 cm apart; and d) a second corona electrode disposed within 3 cm of the surface of the photoreceptor, but not in contact therewith, after the erase lamp in the direction of rotation of the photoreceptor, the erase lamp and the second corona electrode being less than 1 cm apart.

2. The apparatus according to claim 1, wherein each of the first and the second corona electrodes includes an electrically-conductive support and a plurality of conductive fibers, each fiber attached by only one of its ends to the support.

3. The apparatus according to claim 1, further comprising:

e) a drive adapted to rotate the photoreceptor;

f) a voltage source adapted to selectively provide a first bias to the first corona electrode and adapted to selectively provide a second bias to the second corona electrode; and g) a controller adapted to perform the following steps in order:

cause the drive to rotate the photoreceptor;

cause the charger to charge a selected active area of the photoreceptor with charge of a selected polarity to a selected surface potential;

cause the exposure subsystem to expose the photoreceptor to reduce the magnitude of surface charge in the active area;

cause the transfer station to charge the photoreceptor;

cause the voltage source to apply the first bias to the first corona electrode to charge the photoreceptor to a selected pre-erase potential of a selected polarity;

cause the erase lamp to irradiate the photoreceptor in the active area to neutralize charge on a surface of the photoreceptor in the active area; and cause the voltage source to apply the second bias to the second corona electrode to increase the magnitude of the surface potential of the photoreceptor in the active area, whereby trapped charges in the photoreceptor are removed.

4. The apparatus according to claim 3, wherein the first bias and the second bias are different.

5. The apparatus according to claim 3, wherein each of the first and the second corona electrodes includes an electrically-conductive support and a plurality of conductive fibers, each fiber attached by only one of its ends to the support.

6. The method according to claim 3, wherein no grid is positioned between the first or the second corona electrode and the photoreceptor.

* * * * *